US005910340A

United States Patent [19]

Uchida et al.

[11] Patent Number: 5,910,340

[45] Date of Patent: Jun. 8, 1999

[54] ELECTROLESS NICKEL PLATING SOLUTION AND METHOD

[75] Inventors: Hiroki Uchida; Masayuki Kiso; Takayuki Nakamura; Tohru Kamitamari; Rumiko Susuki; Koichiro Shimizu, all of Hirakata, Japan

[73] Assignee: C. Uyemura & Co., Ltd., Osaka, Japan

[21] Appl. No.: 08/931,832

[22] Filed: Sep. 17, 1997

Related U.S. Application Data

[63] Continuation-in-part of application No. 08/719,628, Sep. 25, 1996, abandoned.

[30] Foreign Application Priority Data

Oct. 23, 1995 [JP] Japan ..... 7-299186
Sep. 17, 1996 [JP] Japan ..... 8-266775

[51] Int. Cl.[6] ..... H01L 21/302

[52] U.S. Cl. ..... 427/437; 427/437; 427/443.1; 106/1.22; 106/1.23

[58] Field of Search ..... 106/1.22, 1.23; 427/437, 443.1

[56] References Cited

U.S. PATENT DOCUMENTS

| | | | |
|---|---|---|---|
| 3,717,482 | 2/1973 | Gulla et al. | 106/1 |
| 3,929,483 | 12/1975 | Wainer et al. | 96/38.4 |
| 4,169,171 | 9/1979 | Narcus | 427/264 |
| 4,503,131 | 3/1985 | Baudrand | 427/672 |
| 4,913,787 | 4/1990 | Kiso | 204/44.3 |
| 4,963,974 | 10/1990 | Ushio et al. | 357/80 |
| 5,232,744 | 8/1993 | Nakamura et al. | 427/437 |
| 5,266,103 | 11/1993 | Uchida et al. | 106/122 |
| 5,318,621 | 6/1994 | Krulik et al. | 106/1.23 |

*Primary Examiner*—Benjamin Utech
*Assistant Examiner*—George Goudreau
*Attorney, Agent, or Firm*—Sughrue, Mion, Zinn, Macpeak & Seas, PLLC

[57] ABSTRACT

To an electroless nickel plating solution comprising a water-soluble nickel salt, a reducing agent, and a complexing agent is added a polythionate or dithionite. The invention also provides a high-build electroless gold plating method comprising the steps of immersing a workpiece in the electroless nickel plating bath, thereby chemically depositing a nickel coating on the workpiece, and immersing the nickel-plated workpiece in an electroless gold plating bath, thereby chemically depositing a gold coating on the workpiece.

2 Claims, 2 Drawing Sheets

ELECTROLESS NICKEL PLATING SOLUTION AND METHOD

CROSS REFERENCE TO RELATED APPLICATION

This application is a continuation-in-part of copending application Ser. No. 08/719,628 filed on Sep. 25, 1996, now abandoned, the entire contents of which are hereby incorporated by reference.

BACKGROUND OF THE INVENTION

1. Field of the Invention

This invention relates to an electroless nickel plating solution having improved fine patterning capability and a method for chemically depositing a nickel coating on a workpiece. It also relates to a high-build gold plating method capable of chemically depositing a thick gold coating on a chemically nickel-plated workpiece, which method is industrially advantageous in forming gold coatings on printed circuit boards and electronic parts.

2. Prior Art

Electroless or chemical nickel plating has been utilized in a wide variety of fields because of its advantageous features. For example, electroless nickel plating has been widely applied to electronic appliances. The electroless nickel plating technology, however, has not fully caught up with the urgent demand from the electronic appliance side.

The demand for reducing the weight of electronic appliances promoted to increase the density of constituent circuits, leading to finer circuit patterns. Several problems arise when conventional electroless plating solutions are used for plating on such fine patterns. A reduced line width gives rise to the problem that plating has a thin shoulder. A narrow pattern pitch gives rise to the problems of a reduced resistance between lines by plating projection or outgrowth and short-circuiting by a plating bridge. By the term "thin shoulder" it is meant that plating does not fully deposit on a shoulder of a circuit runner as viewed in cross section and the plating portion at the shoulder is significantly thinner than the remainder of plating. This is probably because the stabilizer excessively adheres to the shoulder to restrain metal deposition. By the term "plating outgrowth" it is meant that plating protrudes from metallic copper or circuit runners and a coating deposits around the circuit runners. This is probably because palladium ions left adhered around the circuit runners after palladium (activator) treatment are reduced with the electroless nickel plating solution into metallic palladium which exerts catalysis to help nickel deposit thereon.

Also, electroless gold plating is often used in the field of electronic industrial parts such as printed circuit boards, ceramic IC packages, ITO substrates, and IC cards since gold has many advantages including electric conduction, physical properties such as thermo-compression bonding ability, oxidation resistance, and chemical resistance. It is an important problem in the printed circuit board industry to chemically deposit thick gold coatings in an efficient manner.

SUMMARY OF THE INVENTION

An object of the present invention is to provide an electroless nickel plating solution and method which have overcome the problems of a thin shoulder on pattern lines and nickel coating outgrowth and is improved in fine pattern definition.

Another object of the present invention is to provide a high-build electroless gold plating method which is industrially advantageous in that a thick gold coating can be chemically deposited within a short time.

We have found that by adding a polythionate or dithionite to an electroless nickel plating solution, quite unexpectedly the problems of a thin shoulder and nickel plating outgrowth can be overcome and the problem of short-circuiting by bridges is eliminated. We have further found that when a workpiece is subject to chemical nickel plating in an electroless nickel plating bath containing a compound having a sulfur-to-sulfur bond and the nickel-plated workpiece is further subject to chemical gold plating, a gold coating can be briefly deposited to a substantial thickness.

We have further found that when a workpiece is first immersed in an electroless nickel plating bath free of a compound having a sulfur-to-sulfur bond for chemically depositing a nickel undercoating on the workpiece and thereafter immersed in an electroless nickel plating bath containing a compound having a sulfur-to-sulfur bond for chemically depositing a nickel coating on the nickel undercoating, and the dual nickel-plated workpiece is further subject to chemical gold plating, a gold coating can be briefly deposited to a substantial thickness. The gold coating has an excellent outer appearance subject to no discoloration with the lapse of time. The present invention is predicated on these findings.

According to a first aspect of the invention, there is provided an electroless nickel plating solution comprising a water-soluble nickel salt, a reducing agent, a complexing agent, and a polythionate or dithionite.

According to a second aspect of the invention, there is provided an electroless nickel plating method comprising the step of immersing a workpiece in the electroless nickel plating solution defined above, thereby chemically depositing a nickel coating on the workpiece.

According to a third aspect of the invention, there is provided a high-build electroless gold plating method comprising the steps of immersing a workpiece in the electroless nickel plating solution containing a compound having a sulfur-to-sulfur bond, thereby chemically depositing a nickel coating on the workpiece, and immersing the nickel-plated workpiece in an electroless gold plating bath, thereby chemically depositing a gold coating on the workpiece.

In a further aspect, the present invention provides a high-build electroless gold plating method comprising the steps of immersing a workpiece in an electroless nickel plating bath free of a compound having a sulfur-to-sulfur bond, thereby chemically depositing a nickel undercoating on the workpiece; immersing the workpiece in an electroless nickel plating bath containing a compound having a sulfur-to-sulfur bond, thereby chemically depositing a nickel coating on the nickel undercoating; and carrying out electroless gold plating on the dual nickel-plated workpiece.

DETAILED DESCRIPTION OF THE INVENTION

Figure 1:
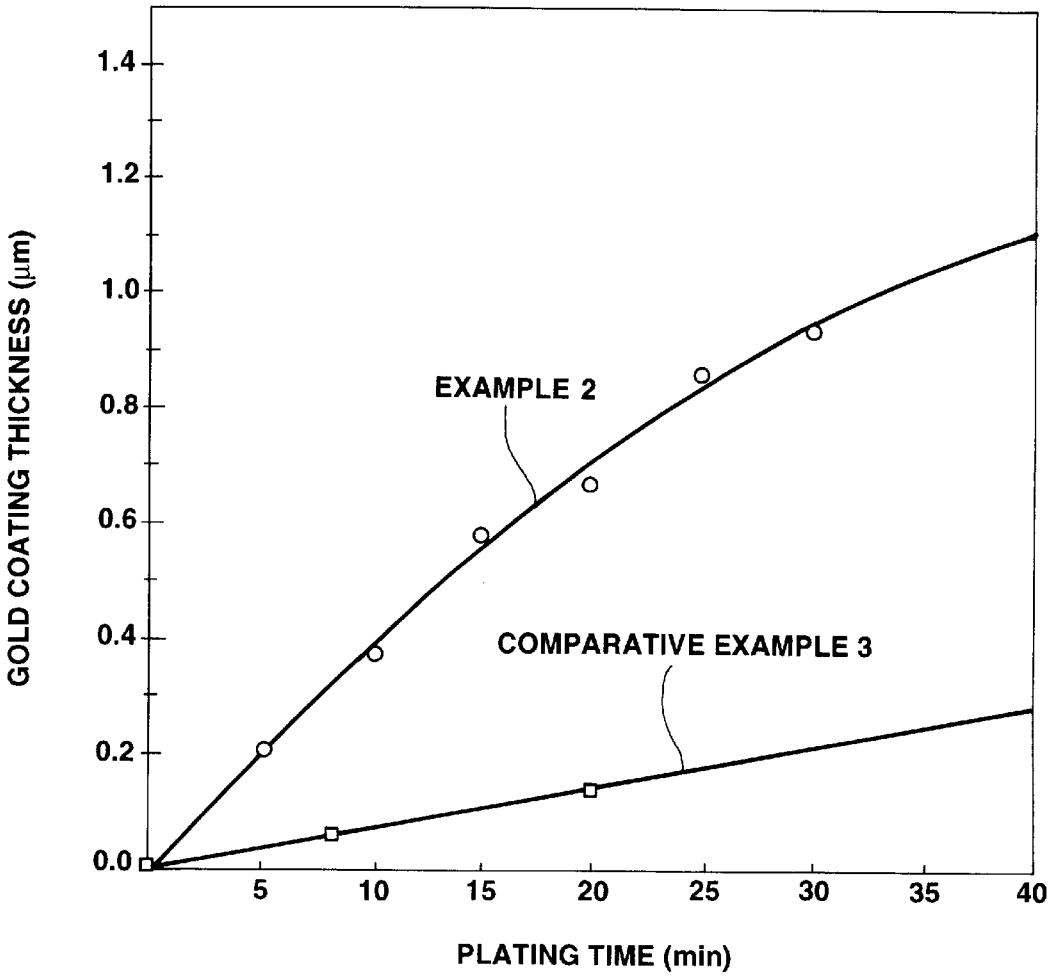
FIG. 1 is a graph showing the thickness of gold coating as a function of plating time when a gold coating is chemically deposited on a chemically deposited nickel coating.

In general, an electroless nickel plating solution contains a water-soluble nickel salt, a reducing agent, and a complexing agent.

Nickel sulfate and nickel chloride are typical of the water-soluble nickel salt. The amount of the nickel salt used is preferably 0.01 to 1 mol/liter, more preferably 0.05 to 0.2 mol/liter.

Examples of the reducing agent include hypophosphorous acid, hypophosphites such as sodium hypophosphite, dimethylamine boran, trimethylamine boran, and hydrazine. The amount of the reducing agent used is preferably 0.01 to 1 mol/liter, more preferably 0.05 to 0.5 mol/liter.

Examples of the complexing agent include carboxylic acids such as malic acid, succinic acid, lactic acid, and citric acid, sodium salts of carboxylic acids, and amino acids such as glycine, alanine, iminodiacetic acid, alginine, and glutamic acid. The amount of the complexing agent used is preferably 0.01 to 2 mol/liter, more preferably 0.05 to 1 mol/liter.

Often a stabilizer is further added to the electroless nickel plating solution. Exemplary stabilizers are water-soluble lead salts such as lead acetate and sulfur compounds such as thiodiglycollic acid. The stabilizer is preferably used in an amount of 0.1 to 100 mg/liter.

According to the invention, a polythionate or dithionite is added to the electroless nickel plating solution. The addition of this compound allows the solution to chemically deposit a nickel coating without the problems of a thin shoulder and nickel coating outgrowth when plating is done on a fine pattern.

The polythionates are of the formula: $O_3S—S_n—SO_3$ wherein n is 1 to 4. Water-soluble salts, typically alkali metal salts are often used. The polythionate or dithionite is preferably added in an amount of 0.01 to 100 mg/liter, especially 0.05 to 50 mg/liter. Less than 0.01 mg/liter would be ineffective for the purpose of the invention whereas more than 100 mg/liter would prevent a nickel coating from depositing.

The electroless nickel plating solution of the invention is at pH 4 to 7, especially pH 4 to 6.

Using the electroless nickel plating solution of the above-mentioned composition, a nickel coating can be chemically formed on a fine pattern or workpiece by conventional techniques, that is, simply by immersing the workpiece in the plating solution. The workpiece to be plated is of a metal which can catalyze reducing deposition of an electroless nickel coating such as iron, cobalt, nickel, palladium and alloys thereof. Non-catalytic metals can be used insofar as they are subject to galvanic initiation by applying electricity to the workpiece until reducing deposition is initiated. Alternatively, electroless plating is carried out on a non-catalytic metal workpiece after a coating of a catalytic metal as mentioned above is previously plated thereon. Furthermore, electroless plating can be carried out on workpieces of glass, ceramics, plastics or non-catalytic metals after catalytic metal nuclei such as palladium nuclei are applied thereto by a conventional technique. The plating temperature is preferably 40 to 95° C., especially 60 to 95° C. If desired, the plating solution is agitated during plating.

When a nickel coating is deposited on a fine pattern from an electroless nickel plating bath according to the invention, little thinning occurs at pattern line shoulders and the short-circuiting problem by bridges due to nickel coating outgrowth is overcome.

A workpiece having a nickel coating chemically deposited thereon is susceptible to electroless gold plating. More particularly, when electroless gold plating is carried out on a nickel coating which has been chemically deposited from an electroless nickel plating solution characterized by containing a compound having a sulfur-to-sulfur bond, a thick gold coating can be deposited within a short time as compared with electroless gold plating on a nickel coating which has been chemically deposited from a conventional electroless nickel plating solution.

In this case, the electroless nickel plating solution contains a water-soluble nickel salt, a reducing agent, and a completing agent, and, if required, a stabilizer, as described above. The electroless nickel plating solution also contains a compound having a sulfur-to-sulfur bond preferably in an amount of 0.01 to 100 mg/liter, especially 0.05 to 50 mg/liter. The compound having a sulfur-to-sulfur bond is preferably inorganic sulfur compound such as thiosulfates, dithionates, polythionates and dithionites although organic sulfur compounds are acceptable. Among them, the polythionates are preferred. Water-soluble salts, typically alkali metal salts are often used.

The electroless gold plating bath used herein contains a gold source, a complexing agent and other components. The gold source may be selected from those commonly used in conventional gold plating baths, for example, gold cyanide, gold sulfite, and gold thiosulfate. A water-soluble salt of gold cyanide such as potassium gold cyanide is especially useful. The amount of the gold source added is not critical although the gold concentration in the bath is preferably 0.5 to 10 g/liter, especially 1 to 5 g/liter. The deposition rate increases in substantial proportion to the amount of the gold source added, that is, the gold ion concentration in the bath. A gold concentration of more than 10 g/liter provides an increased deposition rate, but would render the bath less stable. A gold concentration of less than 0.5 g/liter would lead to a very low deposition rate.

Any of well-known complexing agents may be used in the electroless gold plating bath. For example, ammonium sulfate, aminocarboxylates, carboxylates, and hydroxycarboxylates are useful. The complexing agent is preferably added in an amount of 5 to 300 g/liter, especially 10 to 200 g/liter. Less than 5 g/liter of the complexing agent would be less effective and adversely affect solution stability. More than 300 g/liter of the complexing agent would be uneconomical because no further effect is achieved.

Further, thiosulfates, hydrazine, and ascorbates may be blended as a reducing agent. Exemplary thiosulfates are ammonium thiosulfate, sodium thiosulfate, and potassium thiosulfate. The reducing agents may be used alone or in admixture of two or more. The amount of the reducing agent added is not critical although a concentration of 0 to 10 g/liter, especially 0 to 5 g/liter is preferred. The deposition rate increases in substantial proportion to the concentration of the reducing agent. With more than 10 g/liter of the reducing agent added, the deposition rate would not be further increased and the bath would become less stable. Even if the reducing agent is not added, the gold deposition will take place through substitution reaction with nickel.

In addition to the above-mentioned components, the electroless gold plating bath may further contain pH adjusting agents such as phosphates, phosphites, and carboxylates, crystal adjusting agents such as Tl, As, and Pb, and other various additives.

The electroless gold plating bath is preferably used at about neutrality, often at pH 3.5 to 9, especially pH 4 to 9.

The electroless gold plating bath is used herein as a high-build system. The electroless gold plating method according to the invention can be carried out in a conventional manner except that the above-mentioned electroless gold plating bath is used. Using the above-mentioned electroless gold plating bath, a gold coating can be chemically deposited directly on the workpiece having a nickel coating chemically deposited thereon according to the invention. Especially in an attempt to form a thick gold coating, it is preferred that strike electroless gold plating is followed by high-build electroless gold plating. The preceding strike electroless gold plating serves to modify the surface of the nickel-plated workpiece so as to be receptive to subsequent thick gold plating. As a result, the subsequent thick gold coating closely adheres to the underlying workpiece and becomes uniform in thickness.

The strike electroless gold plating bath used herein has a composition containing a gold source as mentioned above in a concentration of 0.5 to 10 g/liter, especially 1 to 5 g/liter of gold and a complexing agent such as EDTA, alkali metal salts thereof and the above-exemplified agents in a concentration of 5 to 300 g/liter, especially 10 to 200 g/liter. The bath is adjusted to pH 3.5 to 9.

When gold plating is carried out using the electroless gold plating bath mentioned above, preferred plating conditions include a temperature of 20 to 95° C., especially 30 to 90° C. and a time of ½ to 30 minutes, especially 1 to 15 minutes for the strike electroless gold plating bath and a temperature of 20 to 95° C., especially 50 to 90° C. and a time of 1 to 60 minutes, especially 5 to 40 minutes for the high-build electroless gold plating bath. If the high-build electroless gold plating bath's temperature is lower than 20° C., the deposition rate would be slow, which is less productive and uneconomical for thick plating. Temperatures in excess of 95° C. can cause decomposition of the plating bath.

When high-build electroless gold plating is carried out directly on the nickel-plated workpiece, the bath should preferably be at a temperature of 50 to 95° C., especially 70 to 90° C. Bath temperatures below 50° C. would lead to a low deposition rate whereas bath temperatures above 95° C. increase the deposition rate, but would render the resulting gold coating less stable.

According to the present invention, a thick gold coating can be deposited by carrying out electroless gold plating on a nickel coating which has been chemically deposited from an electroless nickel plating solution characterized by containing a compound having a sulfur-to-sulfur bond as mentioned above. In this regard, it is recommended to carry out electroless nickel plating on a workpiece in a bath free of a compound having a S—S bond for chemically depositing a nickel undercoating, thereafter carry out electroless nickel plating in a bath containing a compound having a S-S bond for chemically depositing a nickel coating on the nickel undercoating, and finally carry out electroless gold plating.

The reason is described below. Irrespective of containing a reducing agent in the electroless gold plating bath, chemical plating of gold essentially takes place through substitution reaction with an electroless nickel coating (resulting from a bath containing a compound having a S—S bond), especially when the gold source of the electroless gold plating bath is a salt of gold cyanide, that is, a mechanism that gold ion $Au^+$ is reduced at the same time as the nickel coating is dissolved in the electroless gold plating bath.

$$Ni^0 \rightarrow Ni^{2+} + 2e$$

$$2Au^+ + 2e \rightarrow 2Au^0$$

Figure 2:
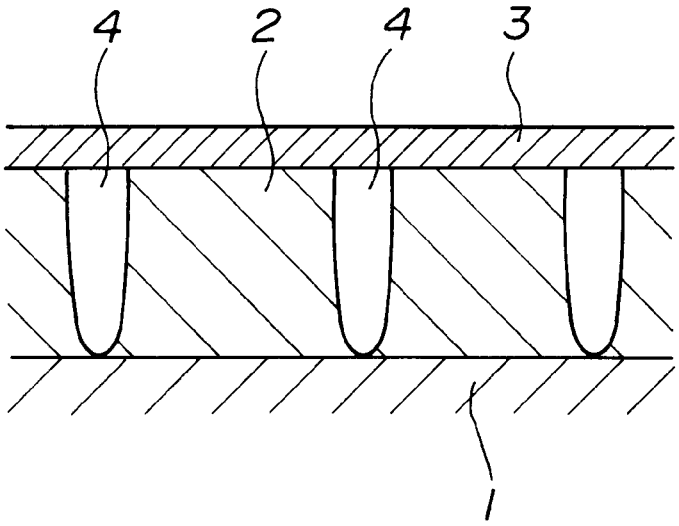
FIG. 2 is a schematic cross-sectional view of a coating structure on a workpiece including a nickel coating and a gold coating, showing pinholes extending through the nickel coating.

Referring to FIG. 2, a workpiece 1 carries a nickel coating 2 deposited thereon from an electroless nickel plating bath containing a compound having a S—S bond and a gold coating 3 deposited thereon from an electroless gold plating bath. The above-mentioned mechanism suggests that during chemical plating of gold, the nickel coating 2 can be locally dissolved to form pinholes 4 which will reach the workpiece 1. Under the situation that the pinholes 4 extend deeply to the workpiece, if the workpiece basis material is a corrodible metal such as copper, the corrodible metal can be dissolved out. Once dissolved, the corrodible metal will migrate through the pinholes and contaminate the electroless gold plating bath and the gold coating being deposited to discolor it.

Figure 3:
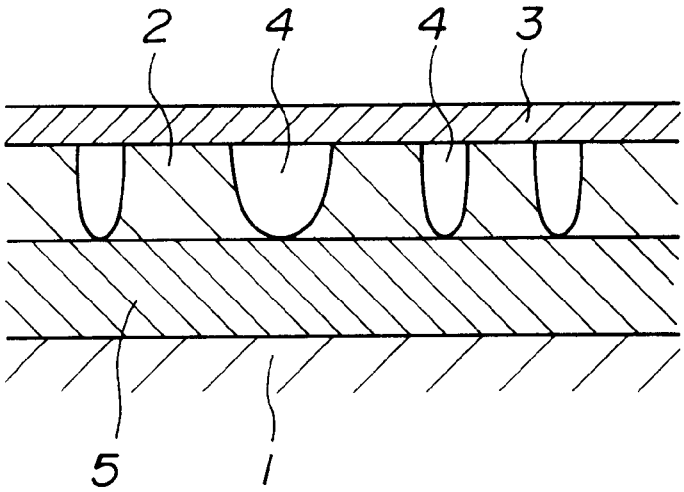
FIG. 3 is a schematic cross-sectional view of a coating structure on a workpiece including a nickel undercoating, a nickel coating and a gold coating, showing pinholes extending through the nickel coating.

FIG. 3 shows the structure of the preferred embodiment wherein a nickel undercoating 5 is interleaved between the workpiece 1 and the nickel coating 2. More particularly, the nickel undercoating 5 is deposited on the workpiece 1 from an electroless nickel plating bath free of a compound having a S—S bond and the nickel coating 2 is deposited thereon from an electroless nickel plating bath containing a compound having a S—S bond. With respect to the dissolution rate of the electroless nickel coating in an electroless gold plating bath (the rate of conversion of gold ion into metallic gold), the nickel coating 2 resulting from an electroless nickel plating bath containing a compound having a S—S bond is significant faster than the nickel undercoating 5 resulting from an electroless nickel plating bath free of a compound having a S—S bond. That is, the nickel undercoating 5 resulting from an electroless nickel plating bath free of a compound having a S—S bond has a very low dissolution rate. Then even if the nickel coating 2 resulting from an electroless nickel plating bath containing a compound having a S—S bond is locally dissolved to form pinholes 4 throughout the coating 2 as shown in FIG. 3, these pinholes 4 terminate at the surface of the nickel undercoating 5. No pinholes are further extended into the nickel undercoating 5. The subsequent situation is that new pinholes are formed in the nickel coating 2 at different sites or the previously formed pinholes 4 are laterally spread.

Accordingly, when electroless gold plating is carried out after the nickel coating 2 from an electroless nickel plating bath containing a compound having a S—S bond is deposited on the nickel undercoating 5 resulting from an electroless nickel plating bath free of a compound having a S—S bond, a gold coating of a substantial thickness can be deposited within a short time without the problems that the electroless gold plating bath can be contaminated with metal ions dissolving out of the workpiece basis material and the gold coating can be discolored therewith.

The composition of an electroless nickel plating bath free of a compound having a S—S bond may be the same as the composition of the above-mentioned electroless nickel plating bath containing a compound having a S—S bond except that the compound having a S—S bond is omitted. Plating conditions may also be the same.

Accordingly, the preferred embodiment employing nickel undercoating is advantageously applicable when the basis metal of the workpiece is a corrodible metal such as copper, for example, the workpiece is a printed circuit board.

Preferably the nickel undercoating resulting from an electroless nickel plating bath free of a compound having a S—S bond has a thickness of 0.5 to 5 μm, especially 1 to 3 μm. On this nickel undercoating, a nickel coating is deposited from an electroless nickel plating bath containing a compound having a S—S bond preferably to a thickness of 0.5 to 5 μm, especially 1 to 5 μm.

Where the workpiece basis is not a corrodible metal, a nickel coating can be deposited directly on the workpiece from an electroless nickel plating bath containing a compound having a S—S bond. In this embodiment, the nickel coating preferably has a thickness of 0.5 to 10 μm, especially 1 to 8 μm. Preferably the nickel coating is deposited to a sufficient thickness to prevent pinholes from extending throughout the coating or to reduce pinholes.

The thickness of the electroless gold coating is not critical although it is generally 0.1 to 2 μm, preferably 0.3 to 0.8 μm.

EXAMPLE

Examples of the present invention are given below by way of illustration and not by way of limitation.

| Comparative Example 1 | | |
|---|---|---|
| Nickel sulfate | 20 | g/l |
| Sodium hypophosphite | 20 | g/l |
| Malic acid | 10 | g/l |
| Sodium succinate | 20 | g/l |
| Lead ion | 1.0 | mg/l |
| pH | 4.6 | |
| Temperature | 85° | C. |
| **Comparative Example 2** | | |
| Nickel sulfate | 20 | g/l |
| Sodium hypophosphite | 20 | g/l |
| Malic acid | 10 | g/l |
| Sodium succinate | 20 | g/l |
| Thiodiglycollic acid | 10 | mg/l |
| pH | 4.6 | |
| Temperature | 85° | C. |
| **Example 1** | | |
| Nickel sulfate | 20 | g/l |
| Sodium hypophosphite | 20 | g/l |
| Malic acid | 10 | g/l |
| Sodium succinate | 20 | g/l |
| Lead ion | 1.0 | mg/l |
| Sodium trithionate | 1.0 | mg/l |
| pH | 4.6 | |
| Temperature | 85° | C. |

Using the respective plating solutions at the indicated temperature, nickel was chemically deposited on a test pattern of copper having a thickness of 18 μm, a line width of 50 μm and a slit width of 50 μm, to form a nickel coating of 5.0 μm thick. Through a stereomicroscope, the nickel coating was visually observed for outgrowth and bridges of nickel over circuit lines. The pattern was cut and the cut section of a circuit line was observed for shoulder thinning through a stereomicroscope. The results are shown in Table 1.

TABLE 1

| Nickel coating | CE1 | CE2 | E1 |
|---|---|---|---|
| Outgrowth | Found | Found | No |
| Bridge | Found | Found | No |
| Thin shoulder | Found | Found | No |

| Example 2 | | |
|---|---|---|
| Nickel sulfate | 20 | g/l |
| Sodium hypophosphite | 20 | g/l |
| Malic acid | 10 | g/l |
| Sodium succinate | 20 | g/l |
| Lead ion | 1.0 | mg/l |
| Sodium thiosulfate | 1.0 | mg/l |
| pH | 4.6 | |
| Temperature | 85° | C. |

Using the above electroless nickel plating solution, a nickel coating of 5 μm thick was chemically deposited on a copper strip. Next, strike plating was carried out on the nickel-plated copper strip in a strike electroless gold plating solution of the following composition under the following conditions and thereafter, a thick gold coating was chemically deposited thereon in a high-build electroless gold plating solution of the following composition under the following conditions. The thickness of the gold coating was measured at intervals. The results are plotted in the graph of FIG. 1.

| Strike electroless gold plating solution | | |
|---|---|---|
| $KAu(CN)_2$ | 1.5 | g/l |
| (AU | 1.0 | g/l) |
| EDTA.2Na | 5.0 | g/l |
| Dipotassium citrate | 30.0 | g/l |
| pH | 7 | |
| Temperature | 90° | C. |
| Time | 7 | min. |
| **High-build electroless gold plating solution** | | |
| $KAu(CN)_2$ | 5.9 | g/l |
| (Au | 4.0 | g/l) |
| Ammonium sulfate | 200 | g/l |
| Sodium thiosulfate | 0.5 | g/l |
| Ammonium phosphate | 5.0 | g/l |
| pH | 6 | |
| Temperature | 90° | C. |

Comparative Example 3

Example 2 was repeated except that the electroless nickel plating solution of Comparative Example 1 was used. The results are also plotted in the graph of FIG. 1.

It is seen from FIG. 1 that when electroless gold plating (Example 2) was carried out on the nickel coating which had been chemically deposited from the electroless nickel plating solution, a significantly thick gold coating can be deposited per unit time as compared with electroless gold plating (Comparative Example 3) on the nickel coating which has been chemically deposited from the electroless nickel plating solution of Comparative Example 1. A gold coating as thick as 0.5 μm or more can be deposited in a short time.

Example 3

Example 2 was repeated except that the electroless nickel plating solution of Example 1 was used. A good result on the gold coating thickness can be obtained.

Example 4

Using an electroless nickel plating solution of the composition shown below, chemical nickel plating was carried out for 15 minutes under the conditions shown below to deposit a nickel undercoating of 2.5 μm thick on a copper strip.

| Nickel undercoating | | |
|---|---|---|
| Nickel sulfate | 20 | g/l |
| Sodium hypophosphite | 20 | g/l |
| Malic acid | 10 | g/l |
| Sodium succinate | 20 | g/l |
| Lead ion | 1.0 | mg/l |
| pH | 4.6 | |
| Temperature | 85° | C. |
| Time | 15 | min. |

Using an electroless nickel plating solution of the composition shown below, chemical nickel plating was carried out for 15 minutes under the conditions shown below to deposit a nickel coating of 3.0 μm thick on the nickel undercoating.

| Nickel coating | | |
|---|---|---|
| Nickel sulfate | 20 | g/l |
| Sodium hypophosphite | 20 | g/l |
| Malic acid | 10 | g/l |
| Sodium succinate | 20 | g/l |
| Lead ion | 1.0 | mg/l |
| Sodium thiosulfate | 1.0 | mg/l |
| pH | 4.6 | |
| Temperature | 85° | C. |
| Time | 15 | min. |

Next, strike plating was carried out for 7 minutes on the dual nickel-plated copper strip in a strike electroless gold plating solution of the same composition under the same conditions as in Example 1 and thereafter, gold plating was carried out for 20 minutes in a high-build electroless gold plating solution of the same composition under the same conditions as in Example 1, depositing a thick gold coating of 0.5 μm thick.

The plated strip was kept in air at 150° C. for 4 hours before its outer appearance was examined. No discoloration was found and the outer appearance remained the same as immediately after plating.

After the same test as above, a similar sample without the nickel undercoating was slightly discolored although it was fully acceptable on practical use.

Example 5

Example 4 was repeated except that the electroless nickel plating solution of Example 1 was used as the second electroless nickel plating solution. A good result on the gold coating thickness and discoloration preventing effect can be obtained.

Although some preferred embodiments have been described, many modifications and variations may be made thereto in the light of the above teachings. It is therefore to be understood that within the scope of the appended claims, the invention may be practiced otherwise than as specifically described.

We claim:

1. An electroless nickel plating solution comprising a water-soluble nickel salt in an amount of 0.01. to 1 mol/liter, a reducing agent in an amount of 0.01 to 1 mol/liter, a complexing agent in an amount of 0.01 to 2 mol/liter, and a polythionate or dithionite in an amount of 0.01 to 100 mg/liter.

2. An electroless nickel plating method comprising the step of immersing an electronic appliance in an electroless nickel plating bath comprising a water-soluble nickel salt in an amount of 0.01 to 1 mol/liter, a reducing agent in an amount of 0.01 to 1 mol/liter, a complexing agent in an amount of 0.01 to 2 mol/liter, and a polythionate or dithionite in an amount of 0.01 to 100 mg/liter to electrolessly plate nickel film, wherein a thin shoulder and nickel plating outgrowth are overcome and a shortcircuiting by bridges is eliminated.

* * * * *